United States Patent [19]

Parsons

[11] 4,149,444

[45] Apr. 17, 1979

[54] RHYTHM INSTRUMENT

[76] Inventor: George Parsons, 615 S. 57th St., Philadelphia, Pa. 19143

[21] Appl. No.: 864,728

[22] Filed: Dec. 27, 1977

[51] Int. Cl.[2] ..... G10D 13/02; G10D 13/08

[52] U.S. Cl. ..... 84/404; 84/1.15; 84/DIG. 12

[58] Field of Search ..... 84/402–404, 84/DIG. 12, 1.15

[56] References Cited

U.S. PATENT DOCUMENTS

| | | | |
|---|---|---|---|
| 3,008,367 | 11/1961 | Parsons | 84/1.06 |
| 3,641,864 | 2/1972 | Jakabovicz | 84/403 X |
| 3,659,032 | 4/1972 | May | 84/1.04 |
| 3,956,959 | 5/1976 | Ebihara | 84/1.15 |

*Primary Examiner*—Lawrence R. Franklin
*Attorney, Agent, or Firm*—Stanley Bilker

[57] ABSTRACT

A rhythm instrument utilizing improved sound producing element combinations for the bass, tom-tom and snare sections of an electronic drum to provide an advantageous audio reproduction of the sounds of conventional drums. Specifically, the improved sounding elements provide more accurate snap, staccato, roll, and rim sounds. In overall concept, the audio producing mechanisms include dynamic impact between an extended vibrationally displaceble element secured on opposing ends thereof to a base surface and a resilient band stretched across an upper surface of the vibrational element. Sounds are produced by causing a striker arm having a hard tip portion member to impinge upon the resilient band causing it in turn to strike the displaceable element. A bass sound is provided by a single such unit utlizing a wide metal strip as the displaceable element. Tom-tom sounds are provided by multiple units having wires of varying lengths utilized as the vibrationally displaceable element with the widths being more narrow than that of the bass unit. A single unit using a plurality of metal wires tightly drawn at one end and fanned at its other end provide snare sounds.

13 Claims, 7 Drawing Figures

FIG. 1
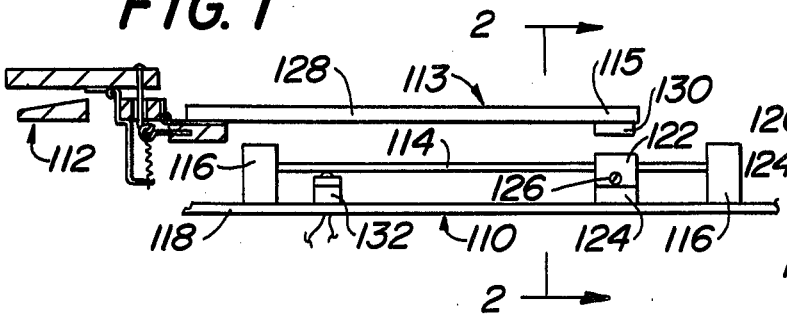
FIG. 2
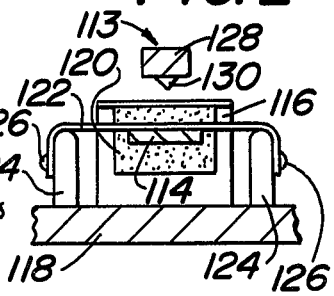
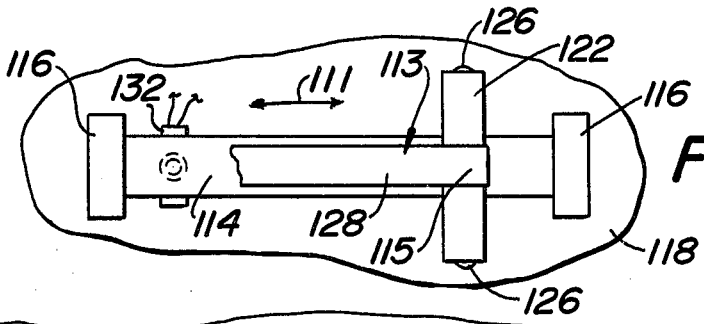
FIG. 3
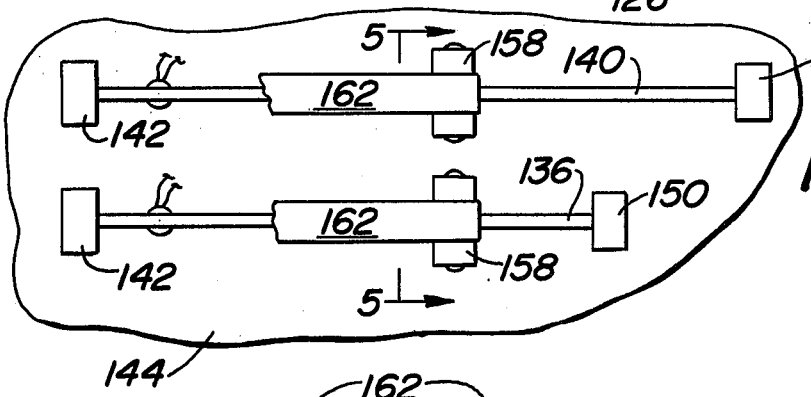
FIG. 4
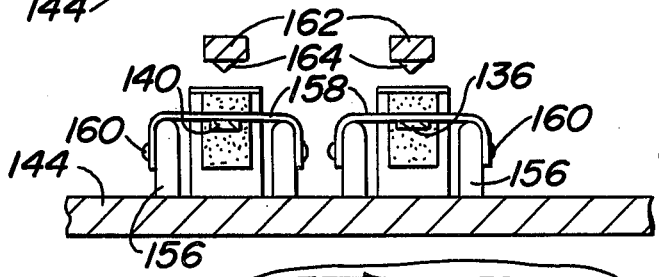
FIG. 5
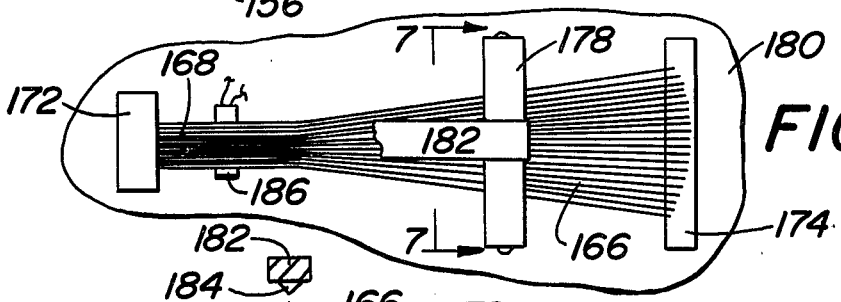
FIG. 6
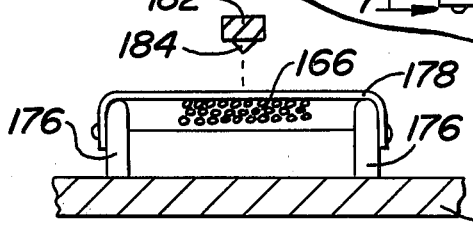
FIG. 7

RHYTHM INSTRUMENT

BACKGROUND OF THE INVENTION

1. Field of the Invention

This invention relates generally to musical instruments and specifically to electronic and electromechanical instruments that imitate the sounds of conventional instruments or produce sounds not produced by conventional instruments. More specifically, this invention relates to sound producing units for electronic drums of the type disclosed and taught in U.S. Pat. No. 3,008,367 which is hereby incorporated by reference.

2. PRIOR ART

U.S. Pat. No. 3,008,367 issued to applicant is the closest prior art known which teaches an electronic drum having a bass section E, a tom-tom section C, a bongo section D, and a snare section B. The vibrating and sound producing elements for each section are one or more metal rods which are hit directly by striker arms attached either to a foot pedal or piano key assembly. The user can, by actuating one or more of such keys and/or foot pedal, produce many different combinations of percussion sounds.

SUMMARY OF THE INVENTION

A rhythm instrument which includes at least one vibrationally displaceable element extending in a predetermined direction. A pair of support elements are secured to the vibrationally displaceable elements. A striker mechanism is displaceably actuatable for inducing audio producing vibrations in the vibrationally displaceable element. A resilient band extends in a direction substantially normal to the predetermined direction and is positionally located between the vibrationally displaceable element and the striker mechanism, while tensioned in abutment with the former.

The bass sound producing element is an elongated flat metal strip supported at each end by a damping block. A resilient band is stretched across the strip and is held taut between two support posts. A striker arm having a hard plastic tip is poised over the elastic band and coupled to a piano key assembly or foot pedal assembly. When actuated, the hard plastic tip impacts the elastic band which in turn strikes the flat strip causing it to vibrate. A magnetic pick-up converts this vibrational energy into an electrical signal that when amplified, produces an accurate bass sound.

The tom-tom sound producing element includes one or more pairs of wires, each having a different length and supported at each end by a damping block. A single resilient band is stretched between two support posts straddling each of the wires. A striker arm and striker tip associated with each wire is positioned such that when the actuated by a piano key assembly, the tip strikes the appropriate wire. A single tom-tom sound or multiple sounds are produced by depressing one or more piano keys.

The snare sound unit includes a plurality of wires tightly bound at one end supported by a damping block and fanned out at the other end and supported by a pillow block. An elastic band similar to those used in the bass and tom-tom sections is stretched across the fanned portion of the wires. A striker arm having a hard tip is positioned above the elastic band so that it impacts the band when actuated by a piano key assembly.

It is therefore the object of this invention to provide sound producing elements for electronic drums that more faithfully reproduce the snap, staccato, roll, rim and other sounds produced by conventional drums.

BRIEF DESCRIPTION OF THE DRAWINGS

FIG. 1 is a side view of the improved bass sound producing element according to the present invention shown in cooperation with a typical piano key assembly used in electronic rhythm instruments;

FIG. 2 is a sectional view taken along lines 2—2 of FIG. 1;

FIG. 3 is a top view of the improved bass sound producing element according to the present invention;

FIG. 4 is a top view of the improved tom-tom sound producing element according to the present invention;

FIG. 5 is a sectional view taken along lines 5—5 of FIG. 4;

FIG. 6 is a top view of the improved snare sound producing element according to the present invention; and, FIG. 7 is a sectional view taken along lines 7—7 of FIG. 6.

DESCRIPTION OF THE PREFERRED EMBODIMENTS

Referring now to FIGS. 1-3, there is shown a combination of elements of an improved rhythm instrument relating to improved bass sounding elements 110. For the purposes of illustration only, bass elements 110 are shown coupled to piano key assembly 112 of the type generally used in such instruments. In the inventor's original patent, U.S. Pat. No. 3,008,367, bass section E was shown actuated by foot pedal E1. The specific means for actuating the improved elements is unimportant to the spirit of the invention. Each of the elements described may be actuated by piano keys, foot pedals, or the like.

The vibrating and primary sound producing member of bass means 110 is vibrationally displaceable element 114 extending in a longitudinal direction defined by directional arrow 111 shown in FIG. 3. Vibrational element 114 is generally planar in contour and extends substantially parallel to base 118 as shown in FIG. 1. Element 114 may be a metal plate formation or a longitudinally directed flat metal strip. Vibrationally displaceable element 114 may be considered analogous to bass wire 88 shown and described in U.S. Pat. No. 3,008,367, of which this concept is an improvement.

Vibrationally displaceable element 114 is secured to support block elements 116 on opposing longitudinal ends thereof. Support block elements 116 are secured in fixed relation to base surface 118 through adhesives, bolting, or some like technique not important to the inventive concept as is herein described.

Support block elements 116 are also utilized as damping mechanisms for damping vibrational displacements induced in element 114. Support blocks 116 include central region 120 formed of a resilient or pliant composition such as rubber or some like material. As is seen in FIGS. 1 and 3, opposing longitudinal ends of strip or plate element 114 are partially embedded into this central pliant region 120 in secured manner. In this manner, blocks 116 furnish both support for strip element 114 and damping to gradually attenuate the vibrations of strip 114 after such is dynamically impacted.

Resilient band element 122 extends in a transverse or substantially normal direction to longitudinal direction 111. Resilient or elastic band 122 is tautly mounted in a secured manner to transversely opposing post members 124. As is seen, resilient band 122 passes above an upper surface of element 114 in contact therewith. Vertically directed post members 124 are fastened to base 118 through bolting or some like technique. Resilient band 122 is fastened to posts 124 by screws 126. Other means for fastening resilient band 122 to post members 124 may be employed, it only being necessary that the band 122 be fastened in such a manner to the posts 124 that it may be held taut with a preselected tension above metal strip member 114.

Striker mechanism 113 is displaceably actuatable for inducing audio producing vibrations in vibrationally displaceable element 114. Striker mechanism 113 includes striker arm member 128 which is vertically displaceable. Arm member 128 is positionally located above plate member 114 and is coupled to piano key actuator 112 in a manner which permits a free end section 115 to be vertically displaced responsive to actuation of key assembly 112.

Mechanism 113 further includes striker tip member 130 secured to striker arm member 128 on a lower surface thereof at end section 115. Striker tip member 130 is formed of a plastic material or some like composition and fastened to arm member 128 through adhesives or some like bonding technique. Thus, plastic tip 128 is fastened to an underside of free hanging end 115 of striker arm 128 above band member 122 where band 122 crosses metal strip 114. Arm 128 is positioned such that when piano key assembly 112 is actuated, hard plastic tip 130 will move downwardly to strike band 122, causing band 122 in turn to impact strip 114. It is this dynamic striking of band 122 and strip 114 by plastic tip 130 that produces improved bass drum sound having a tonal quality that more closely resembles a conventional bass drum.

Particular dimensions for strip 114, the tension and dimensions for band 122, as well as the relative spacing between elements 114 and 122 may be selected to produce the pitch and tonal quality desired by the user.

Magnetic pick-up means 132, similar to the type used on electric guitars and commercially available is positioned on base 118 below strip 114. Pick up 132 is coupled to one or more speakers (not shown) through a conventional amplifier system (not shown).

Referring now to FIGS. 4 and 5, improved sounding elements for the tom-tom (C of U.S. Pat. No. 3,008,367) are detailed in top and sectional views respectively. The same basic design used in the bass section elements is applied to the higher pitched tom-tom section. In place of flat metal strip 114 used in the bass section, a pair of wire strips 136 and 140 of different lengths are used as two separate tom-tom sounding elements. As pictured in FIG. 4, strip 136 is the shortest of the two and is intended to produce the highest pitch sound. Strips 136 and 140 are supported by a pair of tom-tom damping blocks 142 into which one end of the respective strips 136 and 140 are inserted. As in the damping blocks 116, the end of each wire or strip 136 and 140 is embedded in a resilient central region (not shown in FIG. 4) providing both support and damping. Damping blocks 142 are seated on tom-tom base 144 which may be a shelf within the console of the electronic drum. Thus, strips or wires 136 and 140 are mounted and supported within individual damping blocks 142. The individuality and resilient material within the central region of blocks 142 provides sufficient isolation between wires inserted therein such that vibrational energy from one of such wires or strips 136, 140 will not flow through blocks 142 to another of such wires.

Opposing ends of strips 136, 140 are supported in separate damping blocks, block 150 associated with strip 136 and block 154 associated with strip 140. Each of support blocks 150 and 154 are mounted in fixed manner to base 144.

Two support posts 156 flank each strip 136 and 140 and are positioned in a manner such that elastic band 158 may be tautly stretched across them and in contact with strips 136 and 140, as shown more clearly in sectional side view FIG. 5. As in the base section, band 158 is held taut between posts 156 by screw fasteners 160. Each wire 136 and 140 has associated therewith striker arm 162 having one end coupled to a piano key assembly (not shown) similar to assembly 112 in FIG. 1. A plastic tip 164 is mounted to an opposing end of each such striker arm 162. Striker arms 162 are positioned so that the tips 164 of each are poised above band 158 and the wire or strip 136, 140 associated with that particular arm 162. As the piano key associated with a particular striker arm 162 and wire 136 or 140 is depressed, the end of arm 162 having plastic tip 164 is propelled downward, striking band 158 in the region of the appropriate wire and impelling it into that wire. In this manner, the appropriate tom-tom sound producing vibration is induced in one of wires 136 and/or 140. A magnetic pick-up is associated with each of tom-tom wires 136, 140 and provides input for a conventional amplifier and speaker system (not shown).

The snare section is detailed in FIGS. 6 and 7 which are, respectively, top and sectional side views. Although the general design scheme is similar to the bass and tom-tom sections, in place of metal strip 114 used in the bass section and wires 136, 140 used in the tom-tom section, a plurality of snare wires 166 is substituted. Wires 166 are arranged in the shape of a metal strip having a thickness of several wires and having greater width than thickness. At one end 168, wires 166 are bound tightly and inserted into damping block 172. From their point of connection with damping block 172, snare wire group 166 is fanned out in order that its width increases with increased distance from this damping block. The fanned end of wire group 166 rests loosely upon pillow block 174.

Two support posts 176 are positioned such that an elastic band 178 can be stretched across wire group 166 and fastened to posts 176. Support posts 176, damper block 172 and pillow block 174 all seat on a base 180 which can simply be a shelf within the drum console. Striker arm 182 having a hard plastic striker tip 184 attached to one end is coupled to a piano key assembly (not shown) similar to assembly 112 of FIG. 1. Striker arm 182 is located such that striker tip 184 is positioned above elastic band 178 and snare wire group 166. When the piano key assembly (not shown) associated with striker arm 182 is actuated, striker tip 184 is propelled into contact with elastic band 178 which is in turn propelled into brush group 166, producing a "snare" sound closely approximating that of a conventional snare drum. The tension and location of band 178, the thickness and density of wire group 166, and the location of pillow block 174 may be selected to produce tonal qualities desired. As band 178 is moved closer to pillow block 174, a higher sound is produced.

Band 178 provides a recoil for striker arm 182 and helps to produce a "rolling" effect commonly associated with snare drums. A magnetic pick-up 186 similar to those used in the other drum sections, is positioned under wire group 166 and between damper block 172 and elastic band 178.

Therefore, it is apparent that there has been provided improved sounding elements for electronic drums. The use of an elastic band stretched across one or more metal wires or strips that are damped, more faithfully reproduces the sounds of conventional drums than those in widespread use.

Obviously, other embodiments and modifications of the present invention will readily come to those of ordinary skill in the art having the benefit of the teachings presented in the foregoing description and drawings. It is therefore to be understood that this invention is not to be limited thereto and that said modifications and embodiments are intended to be included within the scope of the appended claims.

What is claimed is:

1. A rhythm instrument comprising:

(a) at least one elongated vibrationally displaceable element extending in a predetermined direction;

(b) mounting means supporting said vibrationally displaceable element including means for damping tuned vibrations therein;

(c) striker means displaceably actuatable for inducing audio producing vibrations in said vibrationally displaceable element, including magnetic pick-up means adjacent said vibrationally dispaceable element for converting vibrational energy associated with said element into a corresponding electrical signal; and (d) a resilient band stretched across said said vibrationally displaceable element in a direction substantially normal to said predetermined direction, said resilient band being positionally located between said vibrationally displaceable element and said striker means whereby sound amplification of the electrical signals will produce realistic percussion effects.

2. The rhythm instrument as recited in claim 1 wherein said vibrationally displaceable element is a metal plate member.

3. The rhythm instrument as recited in claim 1 where said mounting means includes resilient block means secured to opposing ends of said vibrationally displaceable element for damping vibrational displacements induced in said element.

4. The rhythm instrument as recited in claim 1 where said striker means includes:

(a) a striker arm member being displaceably actuatable; and, (b) a striker tip member secured to said striker arm member for impacting said resilient band.

5. The rhythm instrument as recited in claim 4 where said striker tip member is formed of a plastic material.

6. The rhythm instrument as recited in claim 1 where said vibrationally displaceable element is a rod element extending in said predetermined direction.

7. The rhythm instrument as recited in claim 6, including a plurality of rod elements adapted to be vibrationally displaced responsive to actuation of said striker means.

8. The rhythm instrument as recited in claim 7 where rod elements are secured in contiguous relation each to the other on one end thereof, and displaced each with respect to the other on an opposing end thereof.

9. In an improved rhythm instrument which includes an elongated vibrator, striker means operatively associated with said vibrator for impact therewith and causing vibrations thereof, damping means associated with said vibrator for damping tuned vibrations therein, and pick-up means operatively associated with an end portion of said vibrator whereby only percussion effects are picked up by said pick-up means, the improvement comprising:

a resilient band stretched across and in contact with said elongated vibrator intermediate said elongated vibrator and said striker means whereby there will be induced vibrational interaction between said elongated vibrator and said resilient band which will produce realistic percussion sounds.

10. The improved rhythm instrument of claim 9 wherein said striker means includes:

(a) a striker arm member being displaceably actuatable; and, (b) a striker tip member secured to said striker arm member for impacting said resilient band.

11. The improved rhythm instrument of claim 10 wherein said vibrator is a flat metal strip elongated in a predetermined direction.

12. The improved rhythm instrument of claim 10 wherein said elongated vibrator is at least one metal rod element.

13. The improved rhythm instrument of claim 12 wherein a plurality of metal rod elements are tightly secured each to the other at one end and fanned out in displaced alignment at an opposing end.

* * * * *